US008783464B2

(12) United States Patent
Holland

(10) Patent No.: US 8,783,464 B2
(45) Date of Patent: Jul. 22, 2014

(54) CONTAINER FABRICATED FROM A BLANK AND METHOD OF FORMING THE SAME

(75) Inventor: Stephen James Holland, Somersworth, NH (US)

(73) Assignee: General Electric Company, Schenectady, NY (US)

( * ) Notice: Subject to any disclaimer, the term of this patent is extended or adjusted under 35 U.S.C. 154(b) by 470 days.

(21) Appl. No.: 13/093,474

(22) Filed: Apr. 25, 2011

(65) Prior Publication Data

US 2012/0266566 A1 Oct. 25, 2012

(51) Int. Cl.
*B65D 85/00* (2006.01)
*B65D 5/48* (2006.01)
*B65D 5/50* (2006.01)

(52) U.S. Cl.
CPC ..... *B65D 5/5004* (2013.01); *B65D 5/48008* (2013.01)
USPC .... 206/722; 206/725; 229/103.3; 229/120.29

(58) Field of Classification Search
USPC ..... 206/722, 725, 721, 427; 229/103.3, 229/120.29, 120.08, 120.17, 120.18, 120.14
See application file for complete search history.

(56) References Cited

U.S. PATENT DOCUMENTS 2,531,090 A * 11/1950 Turner ..... 206/391
2,913,162 A * 11/1959 Goltz ..... 206/509
4,032,009 A 6/1977 Taylor
4,143,803 A 3/1979 Taylor
4,192,444 A * 3/1980 Garmon ..... 229/120.17
4,671,450 A * 6/1987 Lopez ..... 229/120.17
4,967,905 A 11/1990 Steves
5,644,899 A 7/1997 Truesdale
5,772,032 A 6/1998 Goldman
2006/0207905 A1 9/2006 Whiteside
2011/0024318 A1 2/2011 Gilfert

FOREIGN PATENT DOCUMENTS

GB 2 329 376 A 3/1999
WO 2009/123453 A1 10/2009

OTHER PUBLICATIONS

Search Report issued in connection with EP Application No. 12164825.7, Jul. 27, 2012.

* cited by examiner

*Primary Examiner* — Anthony Stashick
*Assistant Examiner* — James Way
(74) *Attorney, Agent, or Firm* — Armstrong Teasdale LLP

(57) ABSTRACT

A blank of material for use in assembling a container is provided. The blank includes four side panels each including a top edge and a bottom edge, and four bottom panels each extending from a respective one of the side panel bottom edges, such that in the assembled container, the bottom and side panels are oriented to at least partially define a compartment configured to store at least one meter therein. The blank further includes at least one securing assembly including a plurality of cutouts shaped and oriented to secure the at least one meter within the compartment in the assembled container, the securing assembly extending from the top edge of one of the side panels.

13 Claims, 5 Drawing Sheets

CONTAINER FABRICATED FROM A BLANK AND METHOD OF FORMING THE SAME

BACKGROUND OF THE INVENTION

The subject matter disclosed herein relates generally to containers and more particularly, to containers used for transporting and storing power meters.

Containers are frequently utilized to store products and/or to aid in transporting products. Known containers have a wide variety of sizes and shapes to accommodate packaging and transporting a wide variety of products. For example, power meters are often shipped and/or stored in containers fabricated from a blank. However, at least some known containers may not adequately protect meters during transportation and/or storage. Accordingly, organizations such as the American National Standards Institute (ANSI) promulgate standards for such containers that facilitate protecting meters stored and/or transported therein.

Due to their configuration, many containers require complex assembly steps in order to be formed. Further, some containers are assembled from separate blanks of sheet material and/or inserts, increasing the amount of time and for assembly. Moreover, many known containers are not reusable once assembled, and such containers cannot be collapsed after use, but rather are discarded after only one use. Finally, often a detailed fabrication process is necessary to satisfy ANSI standards.

BRIEF DESCRIPTION OF THE INVENTION

In one aspect, a blank of sheet material for forming a container is provided. The blank includes four side panels each including a top edge and a bottom edge, and four bottom panels each extending from a respective one of the side panel bottom edges, such that in the assembled container, the bottom and side panels are oriented to at least partially define a compartment configured to store at least one meter therein. The blank further includes at least one securing assembly including a plurality of cutouts shaped and oriented to secure the at least one meter within the compartment in the assembled container, the securing assembly extending from the top edge of one of the side panels.

In another aspect, a container for use in storing meters is provided. The container is formed from a blank of material and includes a bottom wall having a plurality of side edges, and four side walls each extending from a respective one of the bottom wall side edges, such that the bottom wall and the side panels at least partially define a compartment configured to store at least one meter therein. The container further includes at least one securing assembly extending from a top edge of one of the four side walls, the securing assembly including a plurality of cutouts shaped and oriented to secure the at least one meter within the compartment.

In yet another aspect, a method for forming a container from a blank of material is provided. The blank includes a first side panel, a second side panel, a third side panel, and a fourth side panel, each side panel having a top edge and a bottom edge, four bottom panels each extending from the bottom edge of a respective side panel, an attachment panel extending from a side edge of the first side panel, and at least one securing assembly including a plurality of cutouts oriented to secure at least one meter within the formed container, the securing assembly extending from the top edge of one of the side panels. The method includes folding each bottom panel along a respective bottom edge, folding the first side panel along an edge between the first and second side panels, folding the fourth side panel along an edge between the third and fourth side panels, coupling the attachment panel to the fourth side panel, separating the side edge between the first side panel and the attachment panel from an edge between the second side panel and the third side panel, such that the four bottom panels form a bottom wall of the container and each side panel forms a respective side wall of the container, and folding the at least one securing assembly along the top edge, such that the plurality of cutouts are oriented substantially perpendicular to the side walls.

DETAILED DESCRIPTION OF THE INVENTION

The systems and methods described herein enable the simple and efficient assembly of a container. Specifically, the systems and methods as described herein enable a container to be formed that may be used for storing and/or transporting power meters. Further, the containers described herein are formed from a single blank of sheet material and include cutouts that enable a power meter to be secured within the formed containers. The cutouts facilitate preventing damage to meters during transportation and/or storage. Moreover, the containers described herein are easily collapsible, and thus are reusable and easily stored. Lastly, the containers described herein are compliant with packaging standards promulgated by the American National Standards Institute (ANSI), such as transportation and drop tests.

The present invention provides a container formed from a single sheet of material, and a method for constructing the container. The container may be constructed from a blank of sheet material using a machine. In one embodiment, the container is fabricated from a cardboard material. Alternatively, the container may be fabricated using any suitable material, and therefore is not limited to a specific type of material. For example, in alternative embodiments, the container may be fabricated from cardboard, plastic, fiberboard, paperboard, foamboard, corrugated paper, and/or any other suitable material that enables the container to function as described herein.

In one embodiment, the container includes at least one marking thereon, such as indicia, that communicates the product, a manufacturer of the product and/or a seller of the product. For example, the marking may include printed text that indicates a product's name and that describes the product, logos and/or trademarks that indicate a manufacturer and/or seller of the product, and/or designs and/or ornamentation that attract attention and/or enhance sales. "Printing," "printed," and/or any other form of "print" as used herein may include, but is not limited to including, ink jet printing, laser printing, screen printing, giclée, pen and ink, painting, offset lithography, flexography, relief print, rotogravure, dye transfer, and/or any suitable printing technique known to those skilled in the art and guided by the teachings herein provided. In another embodiment, the container is void of markings.

Figure 1:
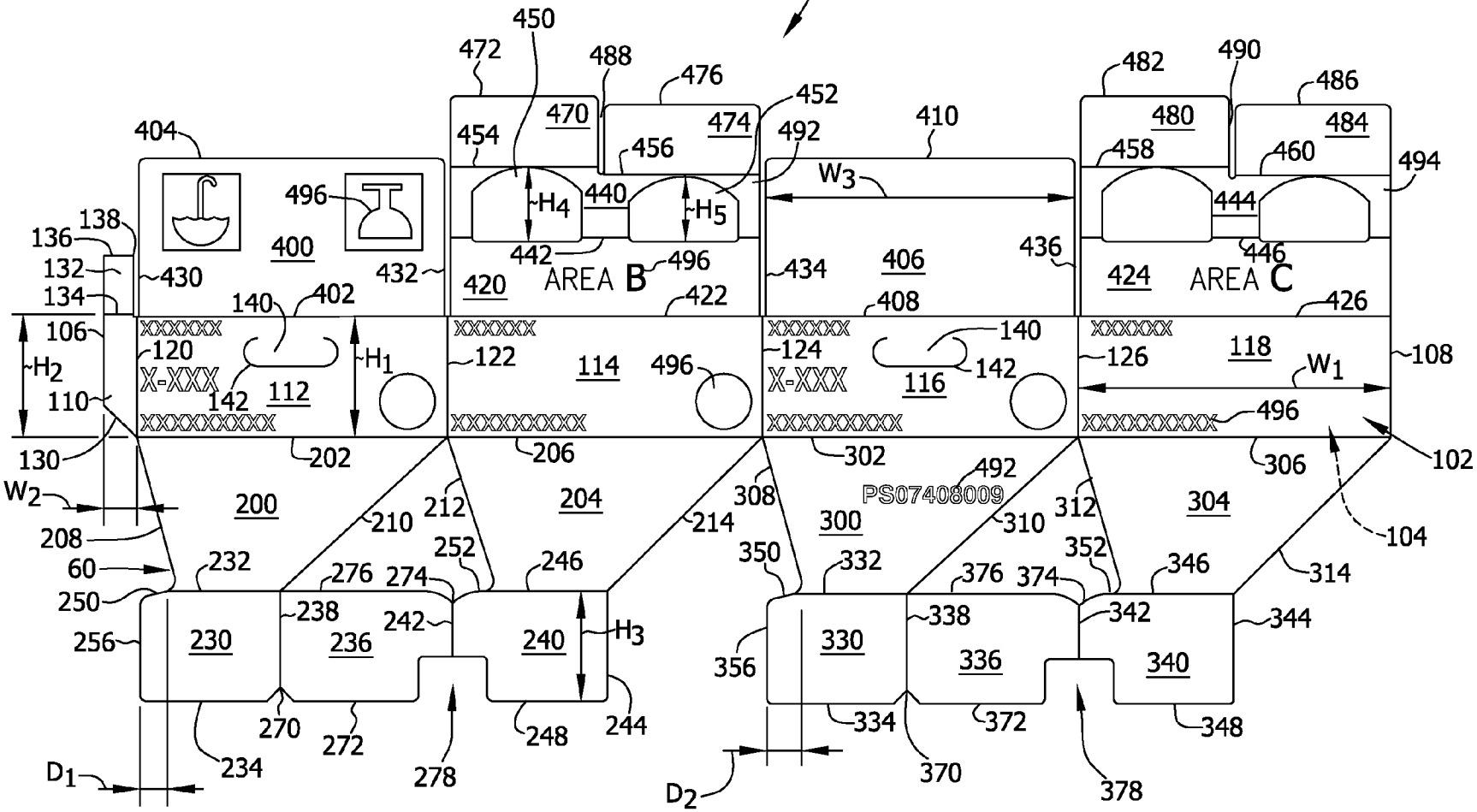
FIG. 1 is a plan view of an exemplary blank of material that may be used to fabricate a container.

FIG. 1 is an exemplary blank 100 of material that may be used to form a container (not shown in FIG. 1). Blank 100 has a first or exterior surface 102 and an opposing second or interior surface 104. Further, blank 100 includes a front edge 106 and an opposing rear edge 108. In the exemplary embodiment, blank 100 also includes, in series from front edge 106 to rear edge 108, an integrally-formed attachment panel 110, a first side panel 112, a second side panel 114, a third side panel 116, and a fourth side panel 118 that extend integrally along preformed fold lines 120, 122, 124, and 126, respectively. In the exemplary embodiment, fold lines 120, 122, 124, and 126 are substantially parallel to each other.

In the exemplary embodiment, attachment panel 110 extends from front edge 106 to fold line 120, and first side panel 112 extends from attachment panel 110 along fold line 120. Moreover, second side panel 114 extends from first side panel 112 along fold line 122, and third side panel 116 extends from second side panel 114 along fold line 124. Similarly, fourth side panel 118 extends from third side panel 116 to rear edge 108. Fold lines 120, 122, 124, and/or 126, as well as any other fold line and/or hinge line described herein, may include any suitable line of weakening and/or line of separation that enables blank 100 and/or container 600 to function as described herein. When a container 600 (shown in FIG. 3) is formed from blank 100, fold line 120 defines a side edge of attachment panel 110 and a side edge of first side panel 112. Similarly, when fully assembled, fold line 122 defines a side edge of first side panel 112 and a side edge of second side panel 114, and fold line 124 defines a side edge of second side panel 114 and a side edge of third side panel 116. Moreover, when fully assembled, fold line 126 defines a side edge of third side panel 116 and a side edge of fourth side panel 118.

In the exemplary embodiment, first side panel 112, second side panel 114, third side panel 116, and fourth side panel 118 are substantially congruent each is substantially rectangular. Moreover, each panel 112, 114, 116, and 118 has a width $W_1$ and a height $H_1$. In the exemplary embodiment, attachment panel 110 is irregularly shaped and includes an obliquely-oriented edge 130 that extends from fold line 120 toward front edge 106. A coupling panel 132 extends from attachment panel 110 along a fold line 134. In the exemplary embodiment, coupling panel 132 includes front edge 106, a first free edge 136, and a second free edge 138.

Attachment panel 110 has a width $W_2$ and a height $H_2$. In the exemplary embodiment, panel width $W_2$ is shorter than each panel width $W_1$, and height $H_2$ is approximately equal to height $H_1$. Alternatively, any of attachment panel 110, first side panel 112, second side panel 114, third side panel 116, and/or fourth side panel 118 may have any dimensions that enable blank 100 and/or assembled container 600 to function as described herein. In the exemplary embodiment, first side panel 112 and third side panel 116 are each formed integrally with a handle 140. Each handle 140 is defined by a perforated line 142 and/or a cut line formed in first and third side panels 112 and 116, respectively.

A first bottom panel 200 extends from first side panel 112 along a fold line 202, and a second bottom panel 204 extends from second side panel 114 along a fold line 206. When container 600 is formed from blank 100, fold line 202 defines a bottom edge of first side panel 112 and a side edge of first bottom panel 200. Similarly, fold line 206 defines a bottom edge of second side panel 114 and a side edge of second bottom panel 204.

In the exemplary embodiment, first and second bottom panels 200 and 204 are substantially congruent and each has a trapezoidal shape. First bottom panel 200 includes a first angled edge 208 and a second angled edge 210, and second bottom panel 204 includes a first angled edge 212 and a second angled edge 214. A first support panel 230 extends from first bottom panel 200 along a fold line 232 to free edge 234, a second support panel 236 extends from first support panel 230 along a fold line 238, and a third support panel 240 extends from second support panel 236 along a fold line 242 to a free edge 244. Third support panel 240 also extends from second bottom panel 204 along a fold line 246 to a free edge 248. Second and third support panels 236 and 240 are substantially congruent.

First angled edge 208 extends from fold line 120 to a free edge 250 of first support panel 230, and second angled edge 210 extends from fold line 122 to fold line 238. First angled edge 212 extends from fold line 122 to a free edge 252 of third support panel 240, and second angled edge 214 extends to free edge 244. First support panel 230 extends a distance $D_1$ from fold line 238 beyond first bottom panel 200, such that a free edge 256 of first support panel 230 is substantially parallel to fold line 120.

In the exemplary embodiment, a notch 270 is defined by free edge 234 and by a free edge 272 of second support panel 236 at fold line 238. Further, a notch 274 is defined by free edge 252 and by a free edge 276 of second support panel 236 at fold line 242. Moreover, an alcove 278 is defined by free edges 248 and 272. Alternatively, no notches or alcoves are defined by and/or included within first, second, and third support panels 230, 236, and 240.

A third bottom panel 300 extends from third side panel 116 along a fold line 302, and a fourth bottom panel 304 extends from fourth side panel 118 along a fold line 306. When container 600 is formed from blank 100, fold line 302 defines a bottom edge of third side panel 116 and a side edge of third bottom panel 300. Similarly, fold line 306 defines a bottom edge of fourth side panel 118 and a side edge of fourth bottom panel 304.

In the exemplary embodiment, third and fourth bottom panels 300 and 304 are substantially congruent and each has a trapezoidal shape. Third bottom panel 300 includes a first angled edge 308 and a second angled edge 310, and fourth bottom panel 304 includes a first angled edge 312 and a second angled edge 314. A fourth support panel 330 extends from third bottom panel 300 along a fold line 332 to free edge 334, a fifth support panel 336 extends from fourth support panel 330 along a fold line 338, and a sixth support panel 340 extends from fifth support panel 336 along a fold line 342 to a free edge 344. Sixth support panel 340 also extends from fourth bottom panel 304 along a fold line 346 to a free edge 348. Fifth and sixth support panels 336 and 340 are substantially congruent.

First angled edge 308 extends from fold line 124 to a free edge 350 of fourth support panel 330, and second angled edge 310 extends from fold line 126 to fold line 338. First angled edge 312 extends from fold line 126 to a free edge 352 of sixth support panel 340, and second angled edge 314 of fourth bottom panel 304 extends to free edge 344. Fourth support panel 330 extends a distance $D_2$ from fold line 338 beyond third bottom panel 300, such that a free edge 356 of third support panel 330 is substantially parallel to fold line 124. Distance $D_2$ is substantially equal to distance $D_1$.

In the exemplary embodiment, a notch 370 is defined by free edge 334 and by a free edge 372 of fifth support panel 336 at fold line 338. Further, a notch 374 is defined by free edge 352 and by a free edge 376 of fifth support panel 336 at fold line 342. Moreover, an alcove 378 is defined by free edges 348 and 372. Alternatively, no notches or alcoves are defined by and/or formed included within fourth, fifth, and sixth support panels 330, 336, and 340. In the exemplary embodiment, first, second, third, fourth, fifth, and sixth support panels 230, 236, 240, 330, 336, and 340 each have a height $H_3$ that is approximately equal to a height $H_1$ of first, second, third, and fourth side panels 112, 114, 116, and 118.

A first major top panel 400 extends from first side panel 112 along a fold line 402 to a free edge 404, and a second major top panel 406 extends from third side panel 116 along a fold line 408 to a free edge 410. A first minor top panel 420 extends from second side panel 114 along a fold line 422, and a second minor top panel 424 extends from third side panel 116 along a fold line 426. When container 600 is formed from blank 100, fold line 402 defines a top edge of first side panel 112 and a side edge of first major top panel 400. Similarly, fold line 408 defines a top edge of third side panel 116 and a side edge of second major top panel 406, and fold line 422 defines a top edge of second side panel 114 and a side edge of first minor top panel 420. Moreover, fold line 426 defines a top edge of fourth side panel 118 and a side edge of second minor top panel 424.

In the exemplary embodiment, first major top panel 400 and second major top panel 406 are each substantially rectangular and are substantially congruent, and each have a width $W_3$ that is approximately equal to width $W_1$ of first, second, third, and fourth side panels 112, 114, 116, and 118. First minor top panel 420 and second minor top panel 424 are also each substantially rectangular and each substantially congruent, and each have width $W_3$.

A cut line 430 is defined between coupling panel 132 and first major top panel 400, and a cut line 432 is defined between first major top panel 400 and first minor top panel 420. Moreover, a cut line 434 is defined between first minor top panel 420 and second major top panel 406, and a cut line 436 is defined between second major top panel 406 and second minor top panel 424.

A first securing panel 440 extends from first minor top panel 420 along a fold line 442, and a second securing panel 444 extends from second minor top panel 424 along fold line 446. First and second securing panels 440 and 444 are substantially congruent. Each of first and second securing panel 440 and 444 includes a first cutout 450 and a second cutout 452. In the exemplary embodiment, first and second cutouts 450 and 452 are "D-shaped". First cutout 450 on first securing panel 440 extends from proximate fold line 442 to a fold line 454, and second cutout 452 on first securing panel 440 extends from proximate fold line 442 to a fold line 456. Further, first cutout 450 on second securing panel 444 extends from proximate fold line 446 to a fold line 458, and second cutout 452 on second securing panel 444 extends from proximate fold line 446 to a fold line 460. First cutout 450 has a height $H_4$ and second cutout 452 has a height $H_5$ that is shorter than height $H_4$ of first cutout 450. Heights $H_4$ and $H_5$ are defined in a direction perpendicular to fold lines 442 and 446. The difference between heights $H_4$ and $H_5$ compensates for an offset defined in the assembled container 600, as described in more detail below.

A first reinforcing panel 470 extends from first securing panel 440 along fold line 454 to a free edge 472, and a second reinforcing panel 474 extends from first securing panel 440 along fold line 456 to a free edge 476. Similarly, a third reinforcing panel 480 extends from second securing panel 444 along fold line 458 to a free edge 482, and a fourth reinforcing panel 484 extends from second securing panel 444 along fold line 460 to a free edge 486. First, second, third, and fourth reinforcing panels 470, 474, 480, and 484 are substantially congruent. Because of the difference between heights $H_4$ and $H_5$, first reinforcing panel 470 is offset with respect to second reinforcing panel 474, and third reinforcing panel 480 is offset with respect to fourth reinforcing panel 484. A cut line 488 is defined between first and second reinforcing panels 470 and 474, and a cut line 490 is defined between third and fourth reinforcing panels 480 and 484. First minor top panel 420, first securing panel 440, and first and second reinforcing panels 470 and 474 form a first securing assembly 492. Second minor top panel 424, second securing panel 444, and third and fourth reinforcing panels 480 and 484 form a second securing assembly 494.

In the exemplary embodiment, blank exterior surface 102 includes a plurality of markings 496 thereon. Alternatively, exterior surface 102 and/or interior surface 104 may include any number of markings, or no markings.

Figure 2:
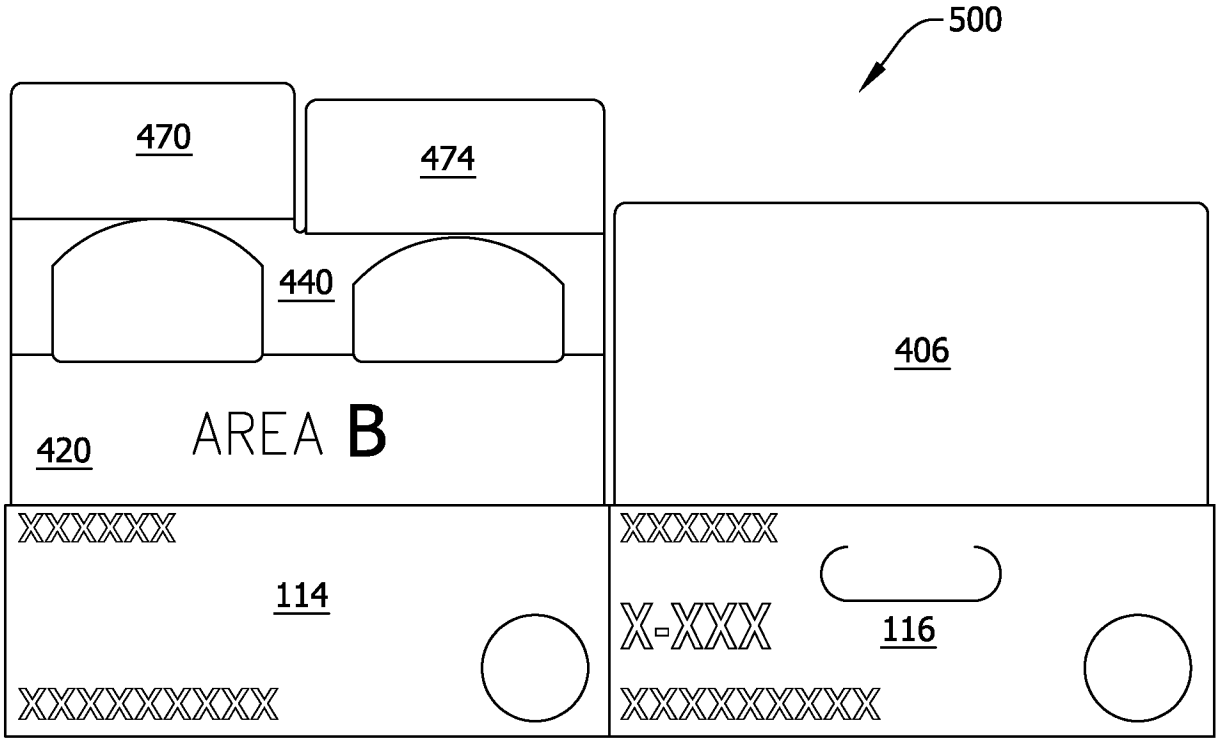
FIG. 2 is a plan view of the blank shown in FIG. 1 in a folded position.

FIG. 2 is a plan view of blank 100 in a substantially flat, folded position 500. To form the folded position 500, first and second bottom panels 200 and 204 are folded along fold lines 202 and 206 respectively, such that the interior surface 104 of first and second bottom panels 200 and 204 faces the interior surface 104 of first and second side panels 112 and 114 respectively. Similarly, third and fourth bottom panels 300 and 304 are folded along fold lines 302 and 306 respectively, such that the interior surface 104 of third and fourth bottom panels 300 and 304 faces the interior surface 104 of third and fourth side panels 116 and 118 respectively.

First and second side panels 112 and 114 are then folded along fold line 122, and second and third support panels 236 and 240 are folded along fold line 242 such that the exterior surface 102 of first bottom panel 200 faces the exterior surface 102 of second bottom panel 204. Similarly, third and fourth side panels 116 and 118 are folded along fold line 126, and fifth and sixth support panels 336 and 340 are folded along fold line 342 such that the exterior surface 102 of third bottom panel 300 faces the exterior surface 102 of fourth bottom panel 304. More specifically, the exterior surface 102 of second support panel 236 is positioned in contact against the exterior surface 102 of third support panel 240, and the exterior surface 102 of fifth support panel 336 is positioned in contact against the exterior surface 102 of sixth support panel 340. The exterior surface 102 of attachment panel 110 is positioned against the interior surface 104 of fourth side panel 118 and the exterior surface of coupling panel 132 is positioned against the interior surface of second minor top panel 424 to form folded position 500. In folded position 500, blank 100 is substantially flat and compact, and thus can be stored easily and efficiently. Further, blank 100 can easily be converted between folded position 500 and container 600 as described in detail below.

Figure 3:
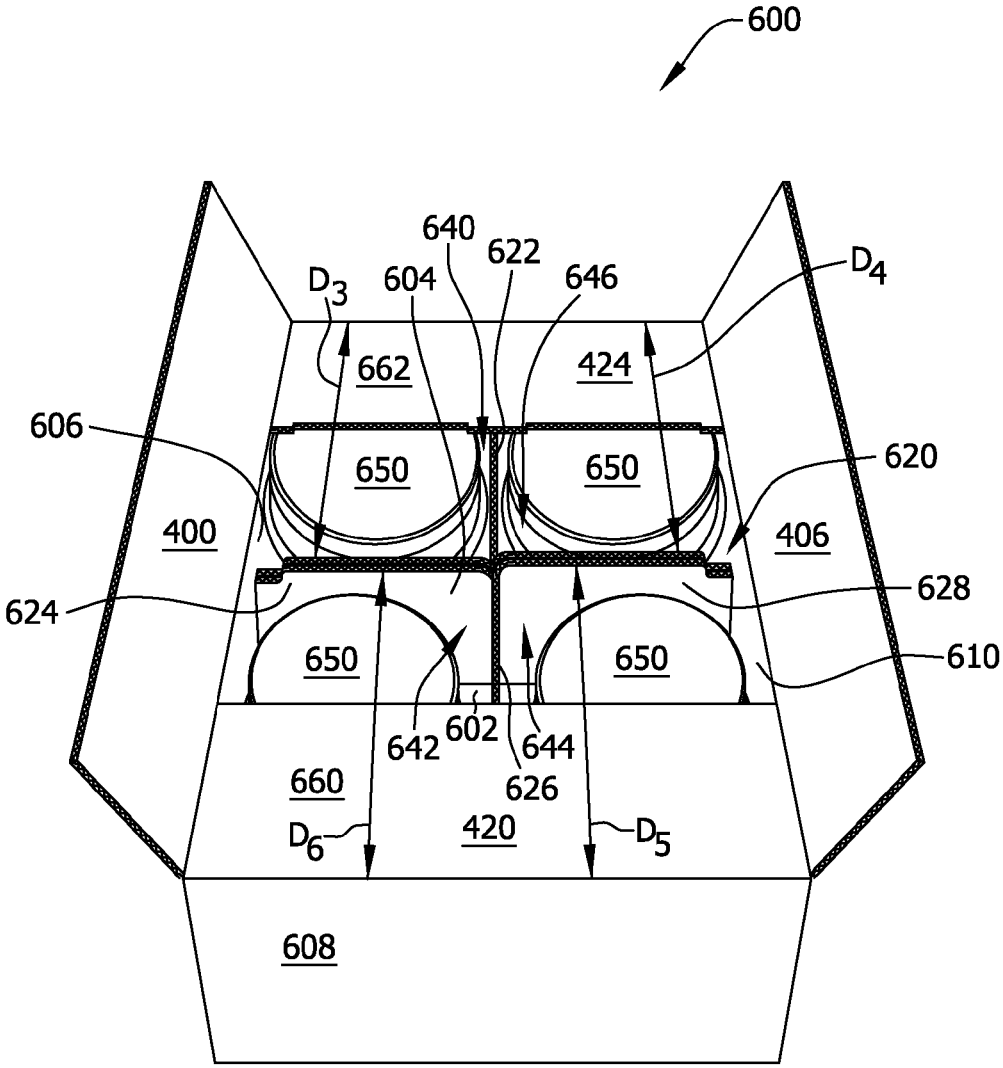
FIG. 3 is a perspective view of an exemplary container formed from the blank of material shown in FIGS. 1 and 2.
Figure 4:
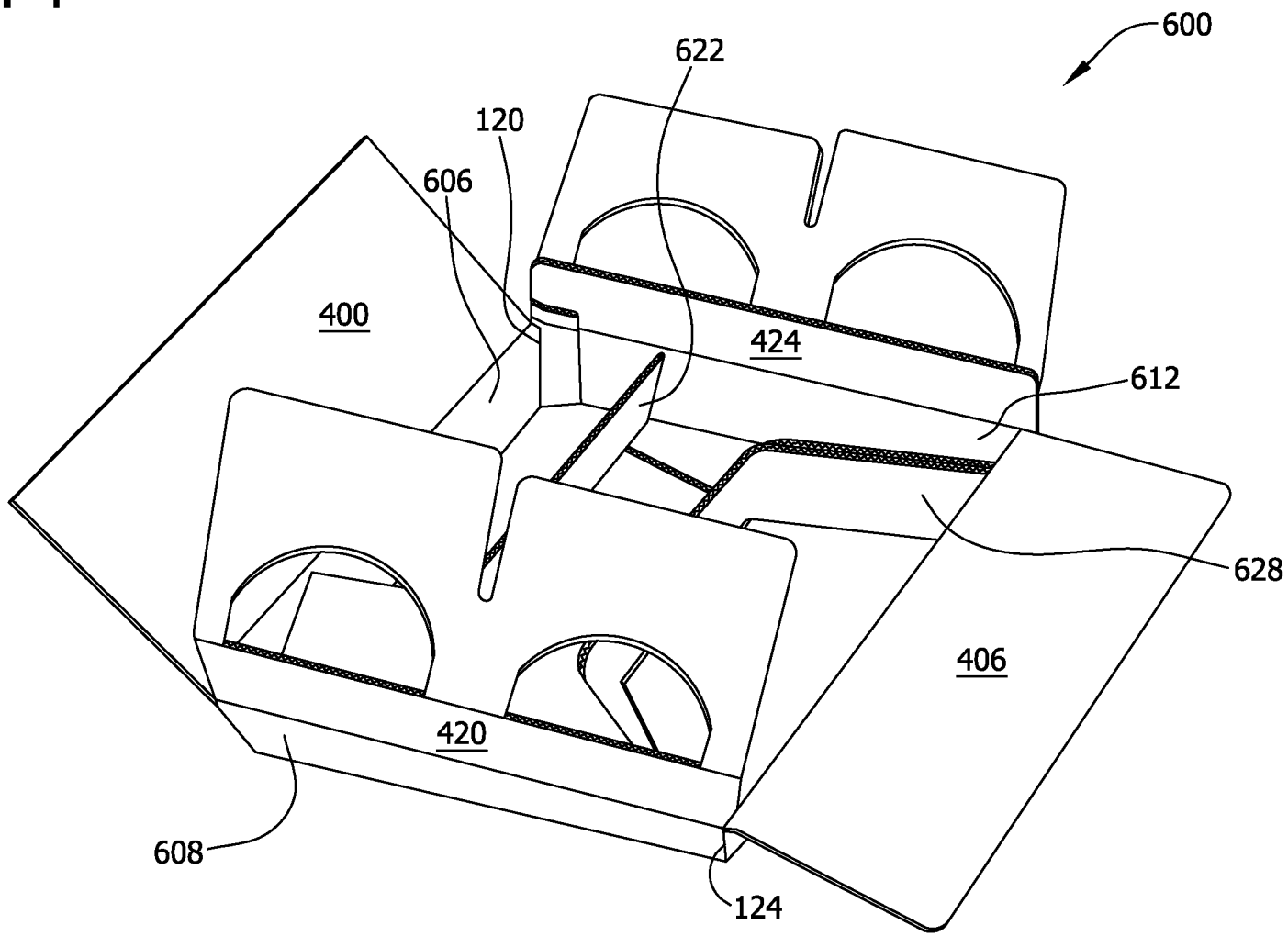
FIG. 4 is a perspective view of the container shown in FIG. 3 in a partially constructed configuration.

FIG. 3 is a perspective view of an exemplary container 600 formed from blank 100. FIG. 4 is a perspective view of a partially constructed container 600. From folded position 500, blank 100 can easily be manipulated to construct container 600. To construct container 600, fold line 120 and fold line 124, which overlap one another in folded position 500, are separated from each other to form a bottom 602, support structure 604, and side walls 606, 608, 610, and 612 of container 600.

With respect to side walls 606, 608, 610, and 612, when fold line 120 and fold line 124 are separated from each other, first side panel 112 forms a first side wall 606, second side panel 114 forms a second side wall 608, third side panel 116 forms a third side wall 610, and fourth side panel 118 forms a fourth side wall 612. First and third side walls 606 and 610 are substantially perpendicular to second and fourth side walls 608 and 612 such that a substantially rectangular enclosure 620 is formed.

With respect to bottom 602, when fold line 120 and fold line 124 are separated from each another, first, second, third, and fourth bottom panels 200, 204, 300, and 304 fold along fold lines 202, 206, 302, and 306, respectively to form bottom 602. In the formed bottom 602, bottom panels 200, 204, 300, and 304 are oriented in an overlapping configuration. That is, second bottom panel 204 overlaps at least a portion of first bottom panel 200, third bottom panel 300 overlaps at least a portion of second bottom panel 204, fourth bottom panel 304 overlaps at least a portion of third bottom panel 300, and first bottom panel 200 overlaps at least a portion of fourth bottom panel 304.

With respect to support structure 604, when fold line 120 and fold line 124 are separated from each other, first support panel 230 forms a first support wall 622, second and third support panels 236 and 240 form a second support wall 624, fourth support panel 330 forms a third support wall 626, and fifth and sixth support panels 336 and 340 form a fourth support wall 628. First support wall 622 is substantially perpendicular to fourth side wall 612, second support wall 624 is substantially perpendicular to first side wall 606, third support wall 626 is substantially perpendicular to second side wall 608, and fourth support wall 628 is substantially perpendicular to third side wall 610.

In the exemplary embodiment, first support wall 622 and third support wall 626 are substantially parallel to one another, and second support wall 624 and fourth support wall 628 are substantially parallel to one another. Second support wall 624 and fourth support wall 628 are offset with respect to each other, such that a separation distance $D_3$ defined between second support wall 624 and fourth side wall 612 is greater than a separation distance $D_4$ defined between fourth support wall 628 and fourth side wall 612. Similarly, a separation distance $D_5$ defined between fourth support wall 628 and second side wall 608 is greater than a separation distance $D_6$ defined between second support wall 624 and second side wall 608.

First and second support walls 622 and 624 form a first compartment 640, second and third support walls 624 and 626 form a second compartment 642, third and fourth support walls 626 and 628 form a third compartment 644, and fourth and first support walls 628 and 622 form a fourth compartment 646. Each compartment 640, 642, 644, 646 is sized to receive and store at least one power meter 650 therein. In the exemplary embodiment, one meter 650 is stacked within each compartment 640, 642, 644, and 646. Alternatively, any number of meters 650 may be stacked within each compartment 640, 642, 644, and 646 that enables container 600 to function as described herein. As used herein a "power meter" includes an electricity meter, an energy meter, a smart meter, and/or any metering device configured to measure an amount of electricity consumed by a residence, a business, and/or an electrically powered device.

To secure meters 650 stored within container 600, first securing panel 440 is folded along fold line 442 such that the interior surface 104 of first securing panel 440 faces the interior surface 104 of first minor top panel 420. Further, second securing panel 444 is folded along fold line 446 such that the interior surface 104 of second securing panel 444 faces the interior surface 104 of second minor top panel 424. First minor top panel 420 is then folded along fold line 422, first reinforcing panel 470 is folded along fold line 454, and second reinforcing panel 474 is folded along fold line 456, such that the interior surfaces 104 of first and second reinforcing panels 470 and 474 face the interior surface 104 of second side wall 608. First securing panel 440 and first minor top panel 420 form a first securing wall 660 that is substantially perpendicular to second side wall 608 and first and to second reinforcing panels 470 and 474. Similarly, second minor top panel 424 is folded along fold line 426, third reinforcing panel 480 is folded along fold line 458, and fourth reinforcing panel 484 is folded along fold line 460, such that the interior surfaces 104 of third and fourth reinforcing panels 480 and 484 face the interior surface 104 of fourth side wall 612. Second securing panel 444 and second minor top panel 424 form a second securing wall 662 that is substantially perpendicular to fourth side wall 612 and to third and fourth reinforcing panels 480 and 484.

First securing wall 660 and second securing wall 662 enable meters 650 to be secured in container 600. More specifically, cutouts 450 and 452 in first and second securing walls 660 and 662 are shaped to receive at least a portion of meters 650 therein, as shown in FIG. 3. Because of the offset between second support wall 624 and fourth support wall 628, meters 650 stored in second compartment 642 and third compartment 644 are offset with respect to each other, and meters 650 stored in fourth compartment 646 and first compartment 640 are offset with respect to each other. The difference between respective heights $H_4$ and $H_5$ of first and second cutouts 450 and 452 corresponds to offset, enables meters 650 to be secured in container 600.

As cutouts 450 and 452 secure meters 650, container 600 facilitates preventing damage to meters 650 during transportation and/or storage in container 600. For example, container 600 may be dropped during transportation and/or storage. When container 600 is dropped, cutouts 450 and 452 facilitate securing meters 650 within container 600, preventing meters stored and/or transported therein from shifting and/or falling out of container 600. Accordingly in one embodiment, container 600 complies with ANSI standards, such as ANSI Standard 12.20 5.5.5.20 (Drop Test).

To close container 600, first major top panel 400 and second major top panel 406 are folded along fold lines 402 and 408 respectively to form a top wall (not shown) of container 600. First major top panel 400 and second major top panel 406 may be sealed and/or adhered to first and second minor top panels 420 and 424 to seal meters 650 inside container 600.

Figure 5:
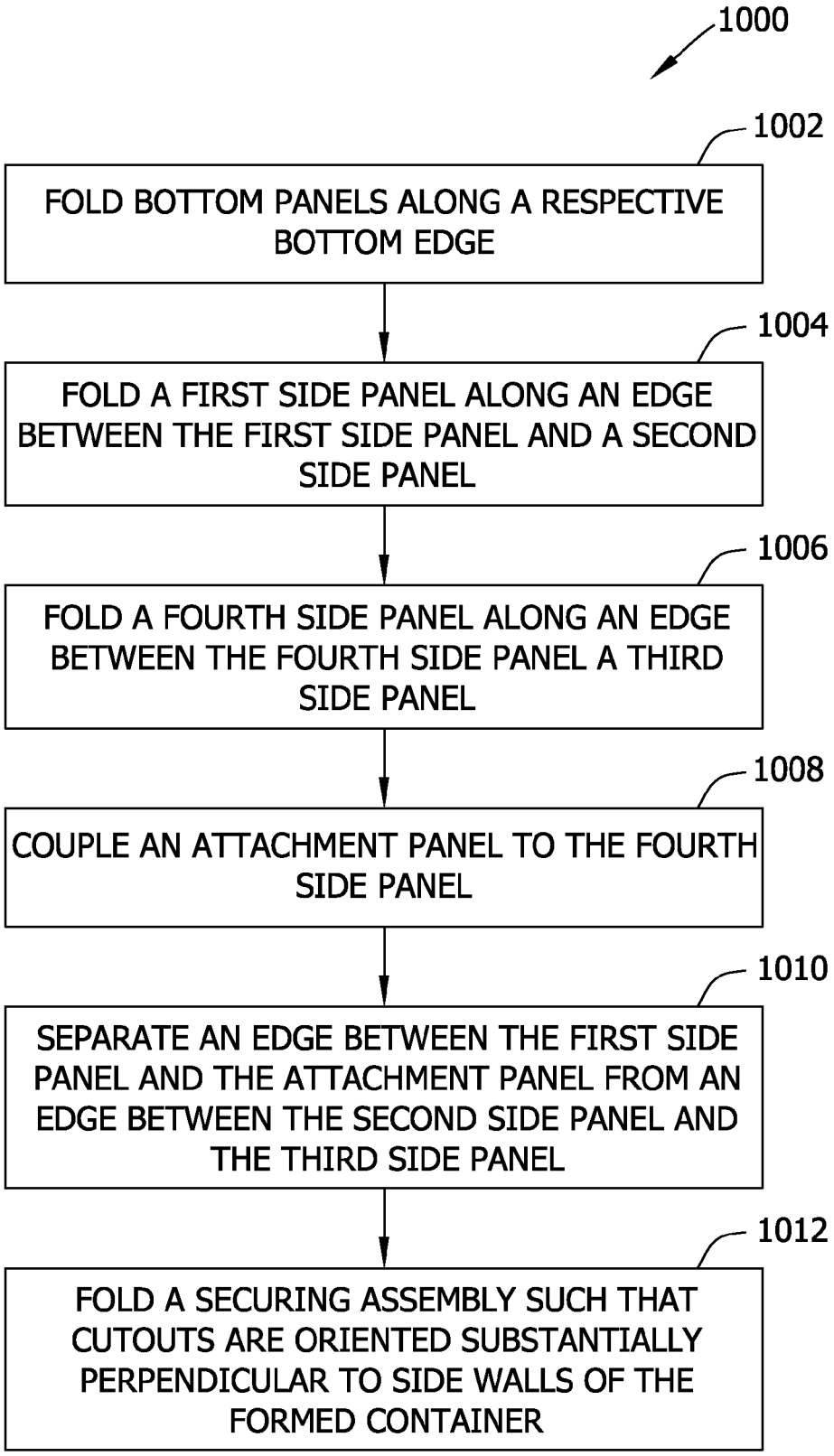
FIG. 5 is a flow chart of an exemplary method that may be used to form a container.

FIG. 5 is a flow chart of an exemplary method 1000 that may be used to form a container 600. Blank 100 includes including a first side panel 112, a second side panel 114, a third side panel 116, and a fourth side panel 118, four bottom panels 200, 204, 300, 304, and an attachment panel 110. The blank 100 further includes at least one securing assembly 492 that extends from one of the side panels 112, 114, 116, and 118. The securing assembly includes cutouts 450 and 452.

To form container 600, each bottom panel 200, 204, 300, and 304 is folded 1002 along a respective bottom edge 202, 206, 302, and 306 of a respective side panel 112, 114, 116, and 118. First side panel 112 is folded 1004 along an edge 122 between first side panel 112 and second side panel 114. Fourth side panel 118 is folded 1006 along an edge 126 between third side panel 116 and fourth side panel 118. Attachment panel 110 is coupled 1008 to fourth side panel 118. An edge 120 between first side panel 112 and attachment panel 110 is separated 1010 from an edge 124 between second side panel 114 and third side panel 116. The four bottom panels 200, 206, 302, and 306 form a bottom 602 of container 600, and the four side panels 112, 114, 116, and 118 form four side walls 606, 608, 610, and 612 of container 600. Securing assembly 492 is folded 1012 such that cutouts 450 and 452 are oriented substantially perpendicular to the side walls 606, 608, 610, and 612.

As compared to known containers, the blanks and containers described herein facilitate quick and efficient of assembly of containers for storing power meters. Further, as compared to known containers, the containers described herein are formed from a single blank of sheet material, and do not require additional blanks and/or inserts for assembly. Moreover, the containers described are reusable, as the containers described herein are easily convertible between a folded position and an assembled position. Finally, the containers described herein are compliant with nationally recognized packaging standards, such as those promulgated by the American National Standards Institute.

The systems and methods described herein enable the simple and efficient assembly of a container. Specifically, the systems and methods as described herein enable a container to be formed that may be used for storing and/or transporting power meters. Further, the containers described herein are formed from a single blank of sheet material and include cutouts that enable a power meter to be secured within the formed containers. The cutouts facilitate preventing damage to meters during transportation and/or storage. Moreover, the containers described herein are easily collapsible, and thus are reusable and easily stored. Lastly, the containers described herein are compliant with packaging standards promulgated by the American National Standards Institute (ANSI), such as transportation and drop tests.

Exemplary embodiments of systems and methods for forming a container are described above in detail. The systems and methods described herein are not limited to the specific embodiments described herein, but rather, components of the systems and/or steps of the methods may be utilized independently and separately from other components and/or steps described herein. For example, the methods and systems described herein may have other applications not limited to practice with containers for storing power meters, as described herein. Rather, the methods and systems described herein can be implemented and utilized in connection with containers for storing and transporting a wide variety of products.

Although specific features of various embodiments of the invention may be shown in some drawings and not in others, this is for convenience only. In accordance with the principles of the invention, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A blank of material for use in assembling a container, said blank comprising:

four side panels each comprising a top edge and a bottom edge;

four bottom panels each extending from a respective one of said side panel bottom edges, such that in the assembled container, said bottom and side panels are oriented to at least partially define a compartment configured to store at least one meter therein; and at least one securing assembly comprising a plurality of cutouts shaped and oriented to secure the at least one meter within the compartment in the assembled container, said securing assembly extending from said top edge of one of said side panels, said at least one securing assembly further comprises:

a minor top panel extending from one of said side panel top edges; and a securing panel extending from a top edge of said minor top panel, said securing panel comprising a securing panel first top edge and a securing panel second top edge, said securing panel first top edge is vertically offset with respect to said securing panel second top edge.

2. A blank in accordance with claim 1, wherein said at least one securing assembly further comprises:

a first reinforcing panel extending from a first top edge of said securing panel; and a second reinforcing panel extending from a second top edge of said securing panel.

3. A blank in accordance with claim 2, wherein said plurality of cutouts are formed in said securing panel.

4. A blank in accordance with claim 3, wherein a first of said plurality of cutouts has a first height that is taller than a second height of a second of said plurality of cutouts, said first and second heights defined in a direction perpendicular to said minor panel top edge.

5. A blank in accordance with claim 1, wherein each of said plurality of cutouts is substantially D-shaped.

6. A blank in accordance with claim 1, further comprising:

a first support panel extending from a bottom edge of a first of said bottom panels;

a second support panel extending from a bottom edge of a second of said bottom panels; and a third support panel extending between said first support panel and said second support panel.

7. A container for use in storing meters, said container formed from a blank of material and comprising:

a bottom wall having a plurality of side edges;

four side panels each extending from a respective one of said bottom wall side edges, such that said bottom wall and said side panels at least partially define a compartment configured to store at least one meter therein; and at least one securing assembly extending from a top edge of one of said four side panels, said securing assembly comprising a plurality of cutouts shaped and oriented to secure the at least one meter within the compartment, said at least one securing assembly further comprises:

a minor top panel extending from one of said side panel top edges;

a securing panel extending from a top edge of said minor top panel, said securing panel comprising a securing panel first top edge and a securing panel second top edge, said securing panel first top edge is vertically offset with respect to said securing panel second top edge.

8. A container in accordance with claim 7, wherein said at least one securing assembly comprises:

said minor top panel and said securing panel forming a securing wall oriented substantially perpendicular to said side panel;

a first reinforcing panel extending from a first top edge of said securing panel; and a second reinforcing panel extending from a second top edge of said securing panel, said first and second reinforcing panels oriented substantially parallel to said side panel.

9. A container in accordance with claim 8, wherein said plurality of cutouts are formed in said securing panel.

10. A container in accordance with claim 7, further comprising a support structure comprising four support walls, each support wall oriented substantially perpendicular to said bottom wall and to a respective one of said four side panels.

11. A container in accordance with claim 10, wherein a first support wall of said support structure and a second wall of said support structure are substantially parallel to each other and offset a distance from each other.

12. A container in accordance with claim 10, wherein said support structure, said bottom wall, and one of said four side panels are oriented to define the compartment.

13. A container in accordance with claim 7, wherein said plurality of cutouts are D-shaped.

* * * * *